United States Patent [19]

Gamberini et al.

[11] Patent Number: 4,875,325

[45] Date of Patent: Oct. 24, 1989

[54] DEVICE FOR TRANSFERRING AND APPLYING SEALING BANDS

[75] Inventors: Antonio Gamberini, Bologna; Marco Brizzi, Zola Predosa, both of Italy

[73] Assignee: G.D. Societa per Azioni, Bologna, Italy

[21] Appl. No.: 183,656

[22] Filed: Apr. 19, 1988

[30] Foreign Application Priority Data

May 8, 1987 [IT] Italy ..... 3468 A/87

[51] Int. Cl.[4] ..... B65B 41/06; B65B 11/08; B65B 41/16

[52] U.S. Cl. ..... 53/137; 53/586; 53/389

[58] Field of Search ..... 53/137, 228, 230, 231, 53/389, 580, 586; 156/285, 497, 552, 556; 271/267, 268

[56] References Cited

U.S. PATENT DOCUMENTS

| | | | |
|---|---|---|---|
| 3,871,943 | 3/1975 | Zodrow | 53/137 |
| 4,194,340 | 3/1980 | McIntyre | 53/228 |
| 4,758,301 | 7/1988 | Inoko et al. | 156/566 |

*Primary Examiner*—Horace M. Culver
*Attorney, Agent, or Firm*—Ladas & Parry

[57] ABSTRACT

A device for transferring sealing bands fed in succession into a packet, from which a withdrawal element provided with two arms extracts them and transfers them to a line feeding packets which during their passage between the arms are provided with the bands; the extraction of each band from the pocket is effected with the aid of a stationary withdrawal element, interposed between the arms, which exerts on the central region of the band a suction action which ceases on the operation of valve means which are of instantaneous action so that the transfer of the band to the line feeding the packets is not hindered or delayed.

6 Claims, 1 Drawing Sheet

DEVICE FOR TRANSFERRING AND APPLYING SEALING BANDS

BACKGROUND OF THE INVENTION

This invention relates to a device for transferring and applying sealing bands. More particularly, the invention relates to a device for transferring gummed sealing bands to a line feeding substantially parallelepiped packets, such as cigarette packets.

In cigarette packeting machines, it is known to normally apply to the finished packet sealing band which are withdrawn by a feed device from the bottom of a pile superposed bands or cut in succession from a continuous strip.

In known feed devices, each sealing bands is withdrawn by a conveyor roller which inserts it into the top of a vertical guide defined by a plurality of pairs of side-by side rollers. During the descent of the bands, which takes place in the direction of their longitudinal dimension along said guide, each band is gummed along its surface by gumming devices, and is finally fed into a pocket which has a side withdrawal aperture facing the ungummed surface of the band. Each band is retained by suction within said pocket, from which it is withdrawn through said aperture by a fork element. This fork element comprises two branches which are provided with suction means arranged to cooperate with the two longitudinal ends of the sealing bands housed in said pocket. These arms are able to traverse normal to the plane of said aperture in order to extract the band from the pocket and then undergo a movement involving rotation of said fork in order to transfer the band to its position of application located on a path followed by the packets.

Each pocket, when moving through the arms of the fork element at the position of application, comes into contact with the gummed surface of the sealing band extended between the arm. In this manner the band separates from the fork and adheres to the leading end of the packet.

A drawback of devices of the aforesaid type is that the fork element often encounters difficulty in extracting the bands from said pocket.

This drawback, which can result in no extraction of the bands and thus interruption in their feed to the packets, occurs particularly frequently in the case of bands having their longitudinal dimension exceeding a determined limit. This is so in the case of sealing bands which are to be applied in the direction of the longitudinal dimension of the end of the cigarette packets instead of in the more common transverse position.

SUMMARY OF THE INVENTION

The object of the present invention is to provide a device for transferring sealing bands which is free of the aforesaid drawbacks.

This is attained according to the invention by a device for transferring and applying sealing bands to a line feeding substantially parallelepiped packets, comprising means for guiding and feeding said bands in the direction of their longitudinal dimension, a pocket receiving said bands at the exit end of said guide and feed means, a withdrawal element for said bands which is arranged to engage the longitudinal ends of each said band within said pocket, drive means arranged to impart to said withdrawal element and to said pocket a movement of mutual retreat and approach, and means for transferring said withdrawal element to a position of application of said bands which is located on the line feeding said packets, said device being characterized by comprising an auxiliary withdrawal element for engaging, inside said pocket, said band between said longitudinal ends.

BRIEF DESCRIPTION OF THE DRAWING

The present invention is described hereinafter with reference to the accompanying drawing, which illustrates a preferred embodiment thereof by way of non-limiting example and in which:

In FIG. 1, the reference numeral 1 indicates a horizontal conveyor positioned at the exit of a cigarette packeting machine (not shown) in order to feed onto a plate 2, and as far as a stop wall 3, a continuous row of cigarette packets 4 disposed edgewise on their supporting surface and advancing in the direction of their longitudinal dimension.

Figure 1:
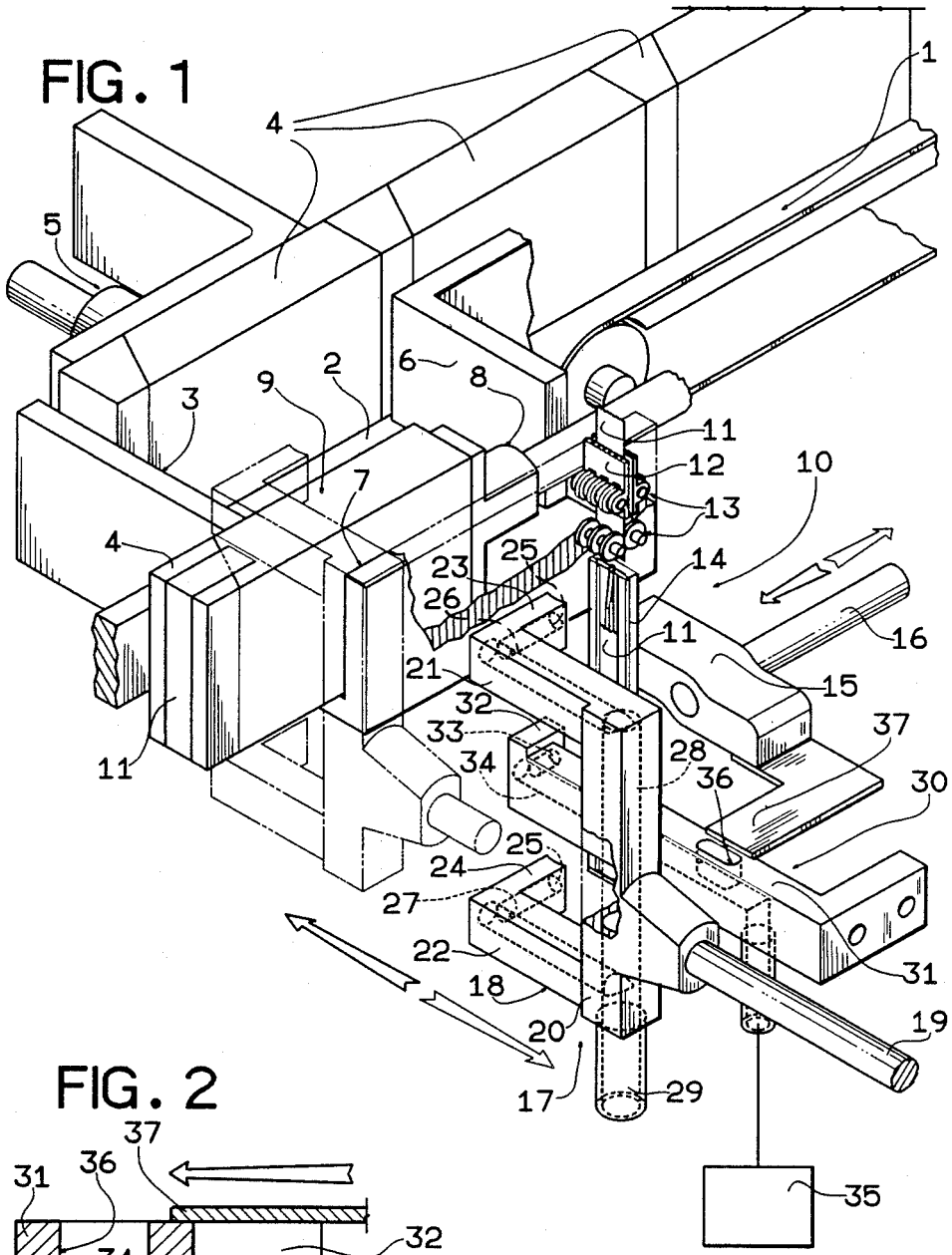
FIG. 1 is a perspective view of a preferred embodiment of a device according to the present invention.

The reference numeral 5 indicates a pusher which is driven with reciprocating movement transversely to the conveyor 1, and which for each outward stroke pushes a packet 4 through a passage defined by the wall 3 and a second wall 6, as far as an end wall 7.

When in this position the packets 4 are disposed on the trajectory of a second pusher 8 driven with reciprocating movement parallel to the conveyor 1, and which for each outward stroke pushes a packet 4 to further transfer means, not shown, through a position, indicated by the numeral 9, in which a sealing band is applied.

The reference numeral 10 indicates overall the means for guiding and feeding previously gummed sealing bands 11. These guide and feed means comprise a vertical track 12 along which the bands 11, urged by roller means 13, descend in the direction of their longitudinal dimension, along a plane parallel to the wall 3, until they become inserted into a pocket 14. The pocket 14 has a substantially C-shaped section when taken on a horizontal plane, and is connected by way of a block 15 to drive means incorporating a shaft 16 extending parallel to the trajectory of the pusher 8 and undergoing axial reciprocating movement at the same frequency as the pushers 5 and 8.

The reference numeral 17 indicates overall a withdrawal element consisting of a fork 18 mounted on transfer means consisting of a horizontal shaft 19 normal to the shaft 16 and driven with an axial reciprocating movement. The fork 18 comprises a vertical bar 20 provided with two arms 21 and 22 extending parallel to the shaft 19 and fixed to the upper end and to the lower end of the bar 20 respectively. The two arms 21, 22, which are vertically aligned, have respective terminal portions 23 and 24 which face the open side of the pocket 14 at the level of its upper end and lower end respectively. In a position facing said pocket 14, both the terminal portions 23 and 24 include an opening 25 providing an outlet of ducts 26 and 27 which are internal to said arms 21 and 22 and are connected, by way of a common inner duct 28 internal to the bar 20 and an external pipe 29, to a suction source not shown.

The reference numeral 30 indicates an auxiliary withdrawal element mounted on fixed support means, not shown, and consisting of an arm 31 parallel to the arms 21 and 22 and interposed between them. That terminal portion 32 of the arm 31 facing the pocket 14 includes an opening 33 providing an outlet of a duct 34 internal to the arm 31 and connected to a suction source 35. The duct 34 communicates with the outside through an aperture or hole 36 which opens into the upper wall of the arm 31.

Figure 2:
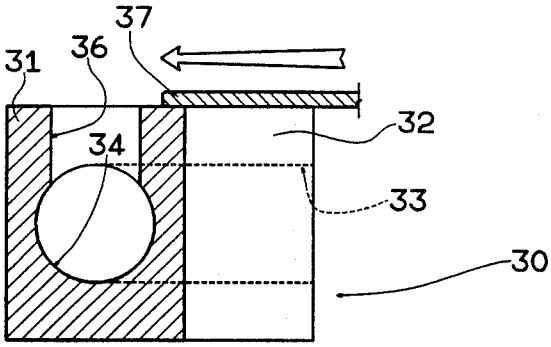
FIG. 2 is a section through a detail of FIG. 1 to an enlarged scale.

The reference numeral 37 indicates closure means for the hole 36 in the form of a horizontal plate rigidly coupled with the shaft 16 driving the pocket 14 (see also FIG. 2). The plate 37 is disposed at the same level as the upper wall of the arm 31 in a position such as to close the hole 36 at each outward stroke of the shaft 16 and to reopen it on each return stroke. Consequently, depending on whether the hole 36 is open or closed by the plate 37, the auxiliary withdrawal element 30 is either able to not able to exert a suction force through its terminal portion 32.

It is therefore apparent that the hole 36 and plate 37 provide an instantly acting valve means for the auxiliary withdrawal element 30.

When in use, the device of the present invention operates in the following manner.

The sealing bands 11 descend in succession along the vertical track 12 until they are completely inserted in the pocket 14. At this point the shaft 16 undergoes an outward stroke so that during its advancement it closes the hole 36 in the arm 31 with the plate 37 to finally, when in its end-of-travel position, bring said pocket 14 into contact with the withdrawal element 17 and with the auxiliary withdrawal element 30.

As a result of this, the sealing band 11 is subjected to a suction force at three separate regions, namely at its two longitudinal ends, which are subjected to the action of the arms 21 and 22, and in its central region, which is subjected to the action of the arm 31. When the shaft 16 commences its return stroke, the band 11 is extracted from the pocket 14 by the joint action of the withdrawal elements 17 and 30.

As the pocket 14 is returned towards its position of alignment with the vertical track 12, the movement of plate 37 uncovers the hole 36. The result is that the suction force is no longer applied by the arm 1 to the intermediate region of the sealing band 11, and thus the sealing band 11 remains retained only at its two longitudinal ends by the suction applied at the ends of the two arms 21 and 22.

At this point the withdrawal element 17 is free to commence its outward stroke, to transfer the band 11 from the position facing the pocket 14 to said application position 9, on the trajectory of the packets 4 engaged by the pusher 8. Withdrawal element 17 is shown by the phantom lines at the application position. On passing through the gap between the arms 21 and 22 of the withdrawal element 17, the front end surface of a packet 4 engages the gummed surface of the band 11 extending between the arms 21 and 22. In this manner the central position of the band 11 adheres to the end of the packet 4 and its two longitudinal ends band over to adhere to the two sides.

The shaft 19 then undergoes its return stroke to return the terminal portions 23 and 24 of the arms 21 and 22 into alignment with the terminal portion 32 of the arm 31 in the position facing the pocket 14.

From the aforegoing it is apparent that the action of the auxiliary withdrawal element 30 on the central region of the band 11 facilitates its extraction from the pocket 14 without however causing any interference during the application of the band to the packet 4, and without exerting any delaying action on the transfer of the band 11 to its application position 9.

This latter result is obtained by the aid of the described valve means which instantly deactivates the auxiliary withdrawal element 30 when the band 11 has been extracted from the pocket 14.

What is claimed is:

1. A device for transferring and applying elongated sealing bands to a line feeding substantially parallelepiped packets, comprising:

means for guiding and feeding said bands in the direction of their longitudinal dimension, a pocket receiving said bands at the exit end of said guide and feed means, a withdrawal element for said bands which is arranged to engage each longitudinal end of each said band within said pocket for withdrawal of said band from said pocket, drive means arranged to impart to said withdrawal element and to said pocket a movement of mutual retreat and approach, means for transferring said withdrawal element to a position of application of said bands which is located on the line feeding said packets, and an auxiliary withdrawal element for engaging, inside said pocket, said band between said longitudinal ends at the same time said withdrawal element engages the two ends of said band to assist in the withdrawal of said band from said pocket.

2. A device as claimed in claim 1, wherein said auxiliary withdrawal element is stationary and comprises an arm provided with an end for engaging said band, a duct connecting said end to a suction source, and valve means disposed along said duct.

3. A device as claimed in claim 2, wherein said duct is internal to said arm, and said valve means comprise an aperture provided through said arm and connecting said duct to the outside, and closure means for said aperture which closure means operate synchronously with the approach of said pocket to said withdrawal element.

4. A device as claimed in claim 3, wherein said closure means are rigid with said pocket.

5. A device for transferring and applying elongated sealing bands to a line feeding substantially parallelepiped packets, comprising:

(a) means for guiding and feeding said bands in the direction of their longitudinal dimension, (b) a pocket receiving said bands at the exit end of said guide and feed means, (c) a withdrawal element for said bands which is arranged to engage longitudinal ends of each said band within said pocket, (d) drive means arranged to impart to said withdrawal element and to said pocket a movement of mutual retreat and approach, (e) means for transferring said withdrawal element to a position of application of said bands which is located on the line feeding said packets, (f) a suction source, and (g) a stationary auxiliary withdrawal element for engaging, inside said pocket, said band between said longitudinal ends, said auxiliary withdrawal element comprising an arm provided with an end for engaging said band, a duct connecting said end to said suction source, and valve means disposed along said duct, said valve means comprising an aperture provided through said arm and connecting said duct to the outside, and closure means for said aperture which closure means operate synchronously with the approach of said pocket to said withdrawal element.

6. The device as claimed in claim 5, wherein said closure means are rigidly attached with said pocket.

* * * * *